US006544013B2

(12) United States Patent
Kato et al.

(10) Patent No.: US 6,544,013 B2
(45) Date of Patent: Apr. 8, 2003

(54) OIL PUMP APPARATUS

(75) Inventors: Hiroshi Kato, Kariya (JP); Hisashi Ono, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/962,349

(22) Filed: Sep. 26, 2001

(65) Prior Publication Data

US 2002/0037227 A1 Mar. 28, 2002

(30) Foreign Application Priority Data

Sep. 26, 2000 (JP) ..... 2000-292359

(51) Int. Cl.[7] ..... F03C 2/00

(52) U.S. Cl. ..... 418/15; 418/75; 418/77; 418/79; 418/166; 418/171

(58) Field of Search ..... 418/15, 171, 166, 418/77, 75, 79

(56) References Cited

U.S. PATENT DOCUMENTS 4,986,739 A * 1/1991 Child ..... 418/15
5,660,531 A * 8/1997 Merkle et al. ..... 418/15
5,759,013 A * 6/1998 Miyazaki et al. ..... 417/310

FOREIGN PATENT DOCUMENTS

| | | | | |
|---|---|---|---|---|
| DE | 195 31 359 A1 | | 8/1995 | |
| DE | 199 13 897 A1 | | 3/1999 | |
| GB | 2245657 A | * | 1/1992 | ..... 418/171 |
| JP | 05164060 A | * | 6/1993 | ..... 418/171 |

* cited by examiner

*Primary Examiner*—Thomas Denion
*Assistant Examiner*—Theresa Trieu

(57) ABSTRACT

An oil pump apparatus includes an oil pump housing having a first suction port, a second suction port and a discharge port in the circumferential direction thereof. A shape of the end portion in the anti-rotational direction at the second suction port is formed to be along a shape of the end portion on the rotational direction side of one pump chamber which is sealed momentarily between the two suction ports, and a shape of the inner circumferential end portion of the first suction port is formed to be along the rotational trace of the end portion on the anti-rotational direction side of the pump chamber. A plural first pockets are formed on the driven rotor, and a second pocket is formed on the pump housing to communicate between the pump chamber and one of the first pockets when the pump chamber is communicated to the first suction port.

6 Claims, 7 Drawing Sheets

OIL PUMP APPARATUS

CROSS REFERENCE TO RELATED APPLICATIONS

The present application is based on and claims under 35 U.S.C. § 119 with respect to Japanese Patent Application Nos. 2000-292359 filed on Sep. 26, 2000, the entire contents of which are incorporated herein by reference.

FIELD OF THE INVENTION

The present invention relates to an oil pump apparatus, and more particularly, an oil pump apparatus driven by a drive source for supplying a predetermined amount of pressurized hydraulic oil to the hydraulic oil receiving portion by a control valve which can flow back a part of hydraulic oil discharged from the oil pump.

BACKGROUND OF THE INVENTION

In Unexamined Published Japanese Patent Applications (Kokai) No.Hei.10 (1998)-73084, for example, there is disclosed a conventional oil pump apparatus. The conventional oil pump apparatus comprises an oil pump housing including a first suction port, a second suction port and a discharge port in the circumferential direction thereof, and a drive rotor and a driven rotor disposed rotatably eccentrically each other in the oil pump housing and forming a plurality of pump chambers in the circumferential direction of the rotor. When the drive rotor is driven by the drive source, each of the pump chambers is moved and is communicated to the first suction port, the second suction port and the discharge port in order, respectively.

In the above prior pump apparatus, a shape of the end portion of the second suction port adjacent to the first suction port is formed so as to be along the shape of the end portion of the pump chamber which abuts on the second suction port and which is sealed momentarily between the first suction port and the second suction port. Further, a shape of the end portion of the first suction port adjacent to the second suction port is formed so as to be along the shape of the end portion of the pocket which abuts the second suction port and which is sealed momentarily between the first suction port and second suction port. Thus, an efficient passage is obtained just before each of the pump chambers is sealed and just after the sealing condition of each of the pump chambers is opened.

Here, in a case where the construction of the above described prior oil pump apparatus is adapted to an oil pump apparatus 20 which has drive rotor 22 having four outer teeth 22*a* and driven rotor 23 having five inner teeth 23*a* disposed eccentrically in the oil pump housing 21 as shown in FIG. 1 and pump chambers R being able to change their volume are formed between the drive rotor 22 and the driven rotor 23, as shown by two dotted lines, the shape B1 of the end portion of the second suction port B adjacent to the first suction port A is formed so as to be along the shape R (s portion with slash) of the end portion of the pump chamber R which abuts on the second suction port and which is sealed momentarily between the first suction port A and the second suction port B. Further, as shown by one dotted line in FIG. 1, the shape Ao of the end portion of the first suction port A adjacent to the second suction port is formed so as to be along the shape (curving shape with projection toward inner circumference) R2 of the end portion of the pump chamber R which is adjacent to the first suction port and which is sealed momentarily.

In the above described construction, while the drive rotor 22 and driven rotor 23 are rotated by crank shaft 10 of the vehicle engine (internal combustion engine) counterclockwise as shown in FIG. 1, when the pump chamber R is rotated to the location shown FIG. 2, the end portion of the pump chamber R on the rotational direction side is communicated to the second suction port B and the end portion shown by one dotted line of the pump chamber R on the anti-rotational direction side overlaps with the inner circumference portion of the first suction port A and is communicated to the second suction port A. Accordingly, while the first suction port A is communicated to the discharge port C with the operation of the control valve 30 by which the oil pump apparatus can flow a part of the hydraulic oil discharged from oil pump 20 to the suction side (while a spool 31 disposed in the control valve 30 slides against the biasing force of a spring 33 and closes the connection between a port 31*c* and a port 31*d*), the first suction port A and the second suction port B repeat connection and disconnection. The high pressure hydraulic oil flowed from the discharge port C to the first suction port A through the control valve 30 flows from the first suction port A to the second suction port B through the pump chamber R intermittently. Thus, the amount of the hydraulic oil supplied to the hydraulic oil receiving portion decreases. Further, the pulsation of the hydraulic pressure increases and the noise is generated.

SUMMARY OF THE INVENTION

The present invention provides an oil pump apparatus without the foregoing drawbacks.

In accordance with a first aspect of the present invention, an oil pump apparatus comprises an oil pump housing including a first suction port, a second suction port and a discharge port in the circumferential direction thereof, a drive rotor and a driven rotor disposed rotatably eccentrically in oil pump housing and forming a plurality of pump chambers in the circumferential direction of a rotor, and each of the pump chambers communicating to the first suction port, the second port and the discharge port in order, respectively, when the drive rotor and the driven rotor are rotated, wherein a shape of the end portion on the side of the anti-rotational direction at the second suction port is formed so as to be along a shape of the end portion on the side of the rotational direction at the pump chamber. The pump chamber is sealed momentarily between the first suction port and the second suction port, and a shape of the inner circumferential end portion of the first suction port is formed so as to be along the rotational trace of the end portion on the side of the anti-rotational direction at the pump chamber. The pump chamber is sealed momentarily between the first suction port and the second suction port, wherein a plural first pockets or penetrating holes which can be communicated to the first suction port at outer circumferential portion thereof and which cannot be communicated to each port at the same time are formed on the driven rotor, and a second pocket which can be closed at the inner circumferential portion of the pump housing located at the inner side with respect to the first suction port by the drive rotor which can be communicated respectively to the each pump chamber and the inner circumferential portion of the first pocket or penetrating hole is formed on the pump housing and can communicate each pump chamber with the first suction port through the first pocket or penetrating hole when each pump chamber is communicated to the first suction port.

In accordance with the second aspect of the present invention, an oil pump apparatus comprises an oil pump housing including a suction port, a first discharge port and a second discharge port in the circumferential direction thereof, a drive rotor and a driven rotor disposed rotatably eccentrically in a oil pump housing forming a plurality of pump chambers in the circumferential direction of a rotor. Each of the pump chambers communicates to the suction port, the first discharge port and the second discharge port in order, respectively, when the drive rotor and the driven rotor are rotated, wherein a shape of the end portion on the side of the rotational direction at the first discharge port is formed so as to be along a shape of the end portion on the side of the anti-rotational direction at the pump chamber. The pump chamber is sealed momentarily between the first discharge port and the second discharge port, and a shape of the inner circumferential end portion of the second discharge port is formed along the rotational trace of the end portion in the rotational direction at the pump chamber. A plural first pockets or penetrating holes which can be communicated to the second discharge port at outer circumferential portion thereof and which can not be communicated to each port at the same time are formed on the driven rotor. A second pocket which can be closed at inner circumferential portion of the pump housing located at inner side with respect to the second discharge port by the drive rotor which can be communicated respectively to the each pump chamber and the inner circumferential portion of the first pocket or penetrating hole is formed on the pump housing. Through the first pocket or penetrating hole, each pump chamber communicates with the second discharge port.

In the first aspect of the oil pump apparatus, the pump chamber sealed momentarily is rotated toward that location and communicates with the second suction port, the end portion of the pump chamber on the side of the rotational direction is communicated to the second suction port. However, the end portion of the pump chamber on the side of the anti-rotational direction does not overlap with the first suction port and is not communicated to the discharge port with the operation of the control valve, the first suction port is not communicated to the second suction port through the pump chamber. Therefore, the high pressure hydraulic oil flowed from the discharge port to the first suction port through the control valve does not flow from the first suction port to the second suction port through the pump chamber, and the amount of the hydraulic oil supplied to the hydraulic oil receiving portion is prevented from decreasing. Further, the pulsation of the hydraulic pressure decreases and the generation of the noise is prevented.

Further, just before the pump chamber is sealed momentarily, the hydraulic oil is sucked from the first suction port to the pump chamber through the end portion of the first suction port on the side of the rotational direction and a portion of the pump chamber that overlaps with the end portion of the first suction port in the rotational direction, and the hydraulic oil is sucked from the first suction port to the pump chamber through the first pocket or penetrating hole formed on the driven rotor and the second pocket formed on the drive rotor. Therefore, the area of the communicating passage between the first suction port and the pump chamber can be increased and the flow resistance can be decreased. As a result, the cavitation can be prevented and the pulsation is decreased.

On the other hand, in accordance with the second aspect of the oil pump apparatus, when the pump chamber communicated to the first discharge port is rotated toward the location where the pump chamber is sealed momentarily, the end portion of the pump chamber on the rotational direction does not overlap with the second discharge port and is not communicated to the second discharge port. Accordingly, while the first discharge port is communicated to the suction port with the actuation of the control valve, the first discharge port is not communicated to the second discharge port through the pump chamber and the high pressure hydraulic oil does not flow. Therefore, the amount of the hydraulic oil supplied to the hydraulic pressure is prevented from decreasing and the generation of the noise is also prevented.

Further, just after the pump chamber is sealed momentarily, the hydraulic oil is discharged from the pump chamber to the second discharge port through the end portion of the second discharge port on the side of the anti-rotational direction and a portion of the pump chamber that overlaps with the end portion of the second discharge port on the side of the anti-rotational direction. Also, the hydraulic oil is discharged from the pump chamber to the second discharge port through the first pocket or penetrating hole formed on the driven rotor and the second pocket formed on the pump housing. Therefore, the area of the communicating passage between the pump chamber and the second discharge port can be increased and the flow resistance can be decreased. As a result, the pumping loss as well as the pulsation is decreased.

BRIEF DESCRIPTION OF THE DRAWINGS

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
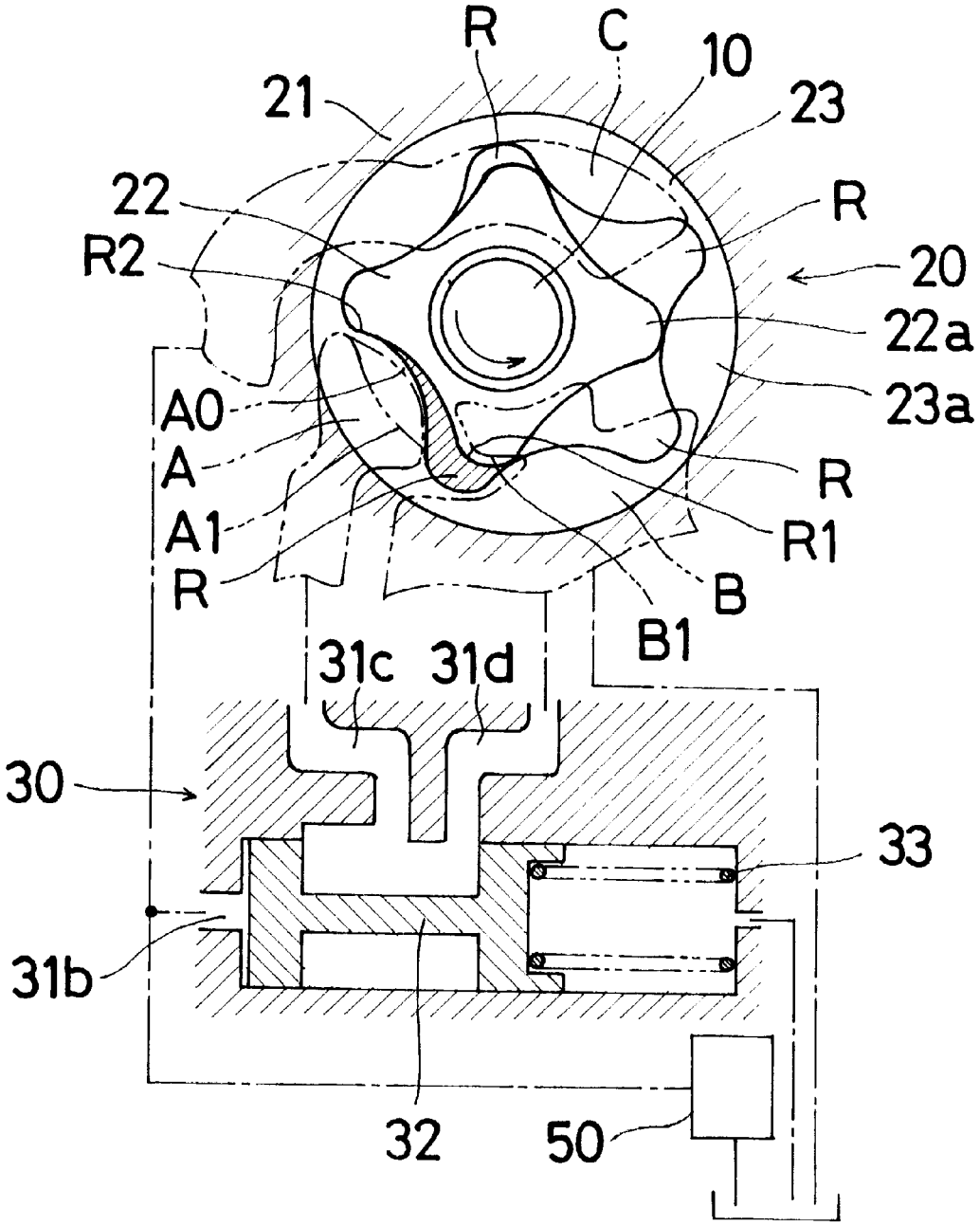
Fig. 1 PRIOR ART
FIG. 1 is a schematic view illustrating an oil pump apparatus in accordance with the present invention.

An embodiment of an oil pump apparatus in accordance with the present invention is described below with reference to the attached drawings.

Referring to FIGS. 3 to 6, there is shown a first embodiment of an oil pump apparatus in accordance with the present invention. The oil pump apparatus 20 includes a driven rotor 23 provided with a plural first pockets 23*b* in each inner teeth 23*a* at regular interval in circumferential direction, and a housing 21 provided with a second pocket 21*a*. It is able to form each of the first pockets 23*b* by a penetrating hole. The other elements are the same as the oil pump apparatus 20 (the oil pump apparatus which has a shape A1 of the inner circumferential end portion of the first suction port A). Therefore, the component elements functioning similarly are designated with the same reference numerals, and will not be detailed herein.

Each first pocket (concave portion) 23*b* is formed on both sides of driven rotor 23. Now, each first pocket 23*b* can be formed at least on either side of driven rotor 23. Each first pocket 23*b* is formed so as to be able to be communicated to a first suction port A at the outer circumferential portion thereof and so as not to be communicated to the first suction port A, a second suction port B and a discharge port C at the same time. Accordingly, referring to FIG. 6, when the first pocket 23*b* is located between the first suction port A and the second suction port B, the first pocket 23*b* can not be communicated to both port A and port B.

Figure 3:
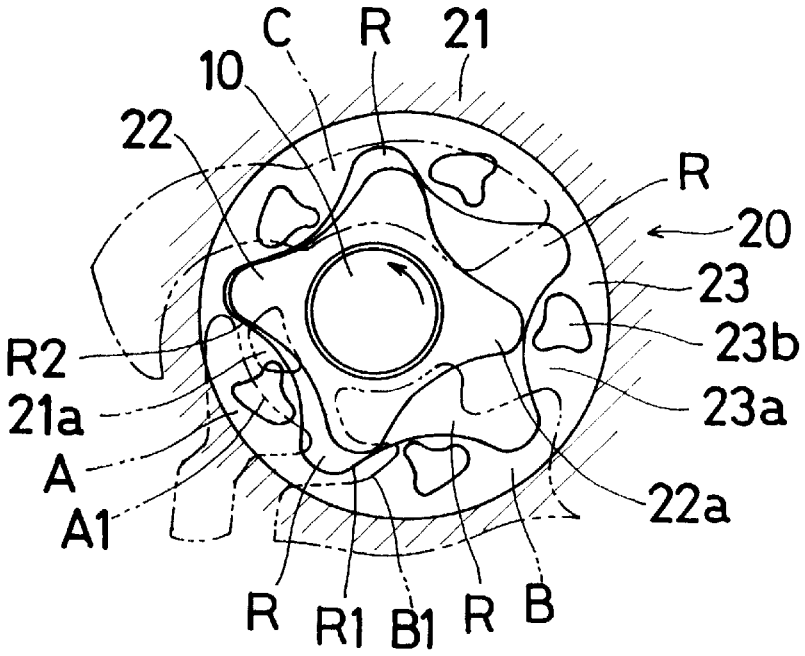
FIG. 3 is a view illustrating the oil pump apparatus in accordance with a first embodiment of the present invention.
Figure 4:
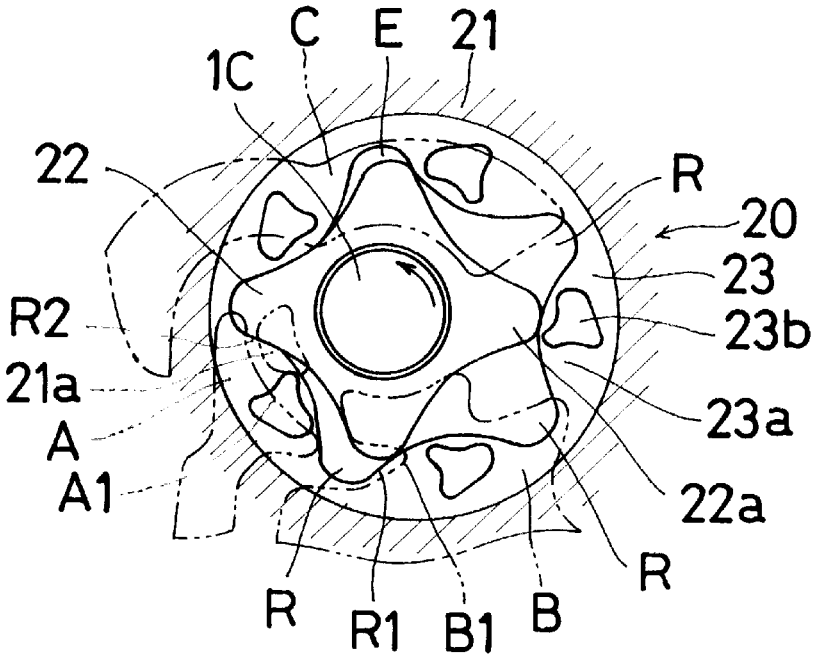
FIG. 4 is a view illustrating the oil pump apparatus in which both rotors shown in FIG. 3 are rotated counter-clockwise.

Referring to FIGS. 3 and 4, when the first pocket 23*b* is located between the second suction port B and the discharge port C, the first pocket 23*b* cannot be communicated to both port B and port C. Further, referring to FIG. 5, when the first pocket 23*b* is located between the discharge port C and the first suction port A, the first pocket 23*b* cannot be connected to both port C and port A.

Figure 5:
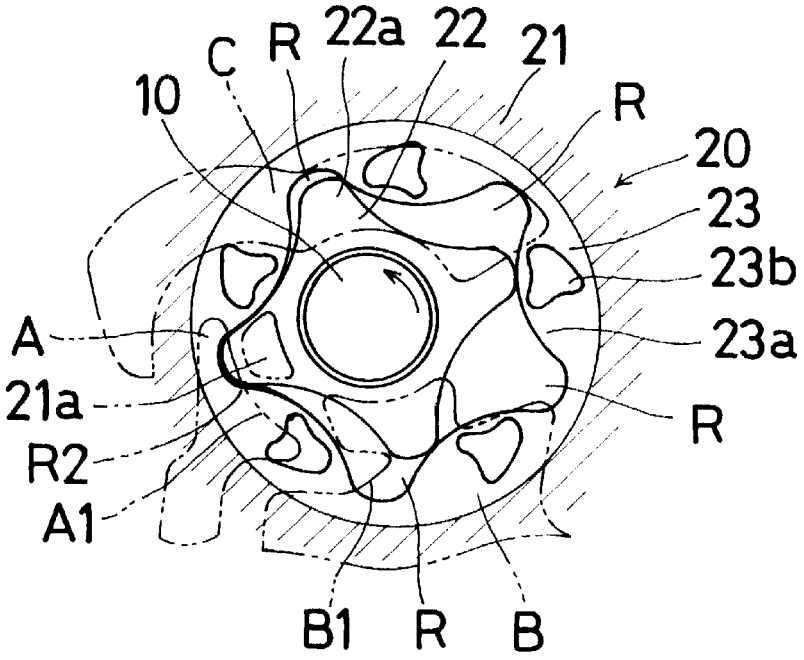
FIG. 5 is a view illustrating the oil pump apparatus in which both rotors shown in FIG. 4 are rotated counter-clockwise.
Figure 6:
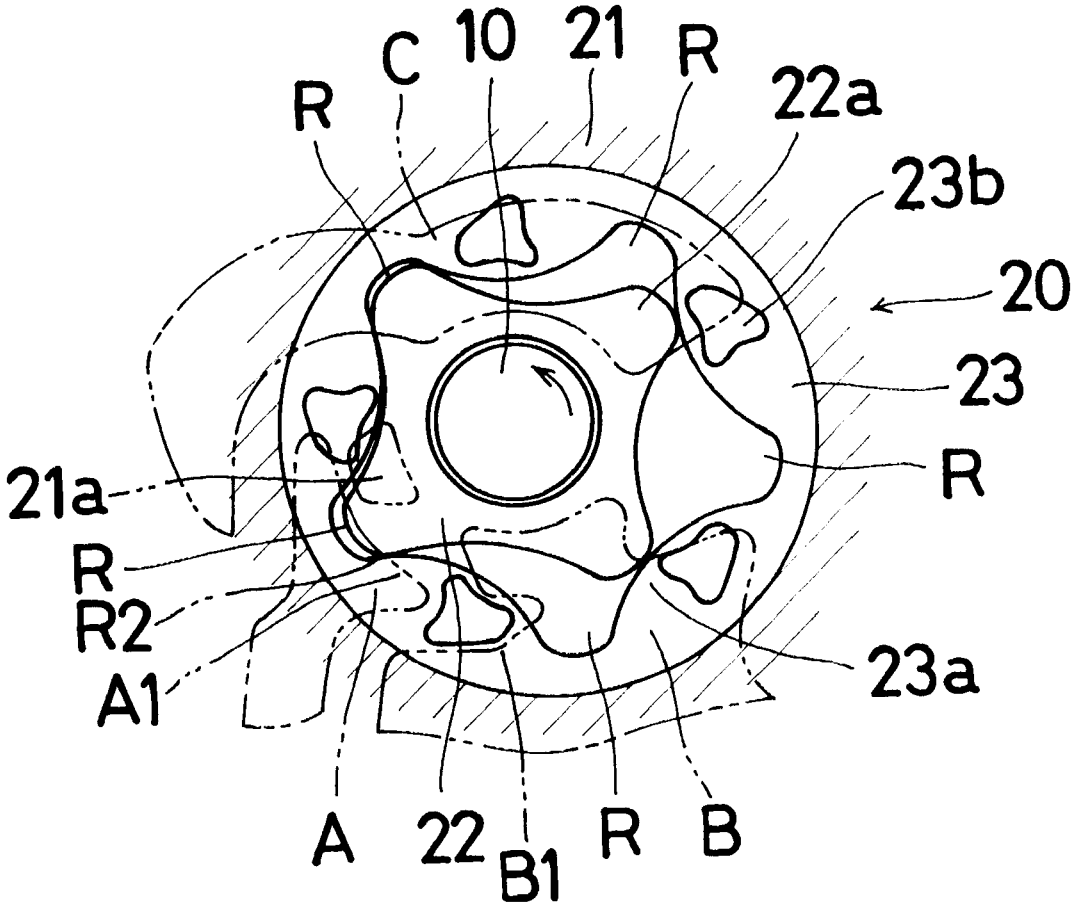
FIG. 6 is a view illustrating the oil pump apparatus in which both rotors shown in FIG. 5 are rotated counter-clockwise.

On the other hand, the second pocket (concave portion) 21*a* is formed at the inner circumferential portion located at the inner side with respect to the first suction port A on the surface of the pump housing 21 on which each sliding side surface of a drive rotor 22 and a driven rotor 23 faces. It is able to form the second pocket 21*a* on the pump housing 21 so as to face at least either of the sliding side surfaces of the drive rotor 22 and the driven rotor 23. The second pocket 21*a* can be closed by the outer teeth 22*a* of the drive rotor 22 as shown in FIG. 5 and can be communicated to each of the pump chambers R and the inner circumferential portion of the each of the first pockets 23*b* formed on the driven rotor 23 as shown in FIGS. 3, 4 and 6. Further, while each of the pump chambers R is communicated to the first suction port A as shown in FIGS. 3 and 6, the second pocket 21*a* can communicate with the first suction port A through the each of the first pocket 23*b* formed on the driven rotor 23.

Figure 2:
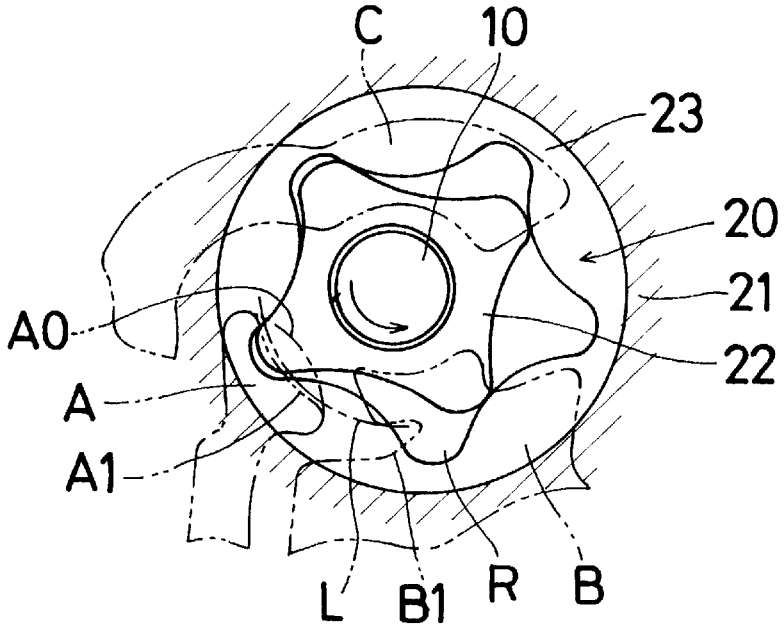
Fig. 2 PRIOR ART
FIG. 2 is a view illustrating the oil pump apparatus in which both rotors shown in FIG. 1 are rotated counter-clockwise.

In the first embodiment shown in FIGS. 3 to 6, a shape B1 of the end portion on the side of the anti-rotational direction at the second suction port B is formed so as to be along a shape R1 of the end portion on the side of the rotational direction at the pump chamber R which is sealed momentarily between the first suction port A and the second suction port B. A shape A1 of the inner circumferential end portion of the first suction port A is formed so as to be along the rotational trace L (see one dotted line in FIG. 2) of the end portion R2 in the anti-rotational direction at the pump chamber R which is sealed momentarily between the first suction port A and the second suction port B. The end portion R2 on the side of the anti-rotational direction at the pump chamber R corresponds to the contact point between the drive rotor 22 and the driven rotor 23.

Accordingly, when the drive rotor 22 and driven rotor 23 are rotated counter clockwise and the pump chamber R sealed momentarily is rotated toward the location where the pump chamber R sealed momentarily is communicated to the second suction port B (namely, when the pump chamber R sealed momentarily is rotated from the location shown in FIG. 4 to the location shown in FIG. 5), the end portion of the pump chamber R in the the rotational direction is communicated to the second suction port B. However, the end portion of the pump chamber R on the side of the anti-rotational direction dose not overlap with the first suction port A and is not communicated to the first suction port A. Accordingly, while the first suction port A is communicated to the discharge port C with the operation of a control valve (see the control valve 30 shown in FIG. 1), the first suction port A is not communicated to the second suction port B through the pump chamber R. Therefore, the high pressure hydraulic oil flowed from the discharge port C to the first suction port A through the control valve does not flow from the first suction port A to the second suction port B through the pump chamber R and the amount of the hydraulic oil supplied to the hydraulic oil receiving portion (see the hydraulic oil receiving portion 50) is prevented from decreasing. Further, the pulsation of the hydraulic pressure decreases and the generation of the noise is prevented.

Further, in a condition shown in FIG. 3 just before the pump chamber R is sealed momentarily as shown in FIG. 4, the hydraulic oil is sucked from the first suction port A to the pump chamber R through the end portion of the first suction port A on the side of the rotational direction and a portion of the pump chamber that overlaps with the end portion of the first suction port A on the side of the rotational direction, and the hydraulic oil is sucked from the first suction port A to the pump chamber R through the first pocket 23*b* and the second pocket 21*a*. Therefore, since a plural suction passages from the first suction port A to the pump chamber R are formed the area of the communicating passage between the first suction port A and the pump chamber R can be increased and the flow resistance can be decreased. As a result, the cavitation can be prevented from occurring and the pulsation can be decreased.

FIGS. 7 to 10 show a second embodiment of the present invention. The oil pump apparatus 120 includes a drive rotor 122 provided with the five outer teeth 122*a* and a driven rotor member 123 provided with six inner teeth 123*a*. The drive rotor 122 and the driven rotor 123 are disposed eccentrically to each other in the oil pump housing 121 and a plural pump chambers R10 being able to change their volume are formed between the drive rotor 122 and the driven rotor 123. Both rotor 122 and 123 are rotated clockwise by the crankshaft 110 of vehicle engine (internal combustion engine).

Further, the oil pump housing 121 includes a suction port D, a first discharge port E and a second discharge port F in the circumferential direction thereof. When the drive rotor 122 and the driven rotor 123 are rotated, each of the pump chambers R10 is moved and is communicated to the suction port D, the first discharge port E and the second discharge port F in order, respectively.

In the second embodiment, a shape E1 of the end portion on the side of the rotational direction at the first discharge port E is formed so as to be along a shape R11 of the end portion in the anti-rotational direction at the pump chamber R10 which is sealed momentarily between the first discharge port E and the second discharge port F, and a shape F1 of the inner circumferential end portion of the second discharge port F is formed so as to be along the rotational trace of the end portion R12 in the rotational direction at the pump chamber R10 which is sealed momentarily between the first discharge port E and the second discharge port F. The end portion R12 in the rotational direction at the pump chamber R10 corresponds to the contact point between the drive rotor 122 and the driven rotor 123.

Figure 7:
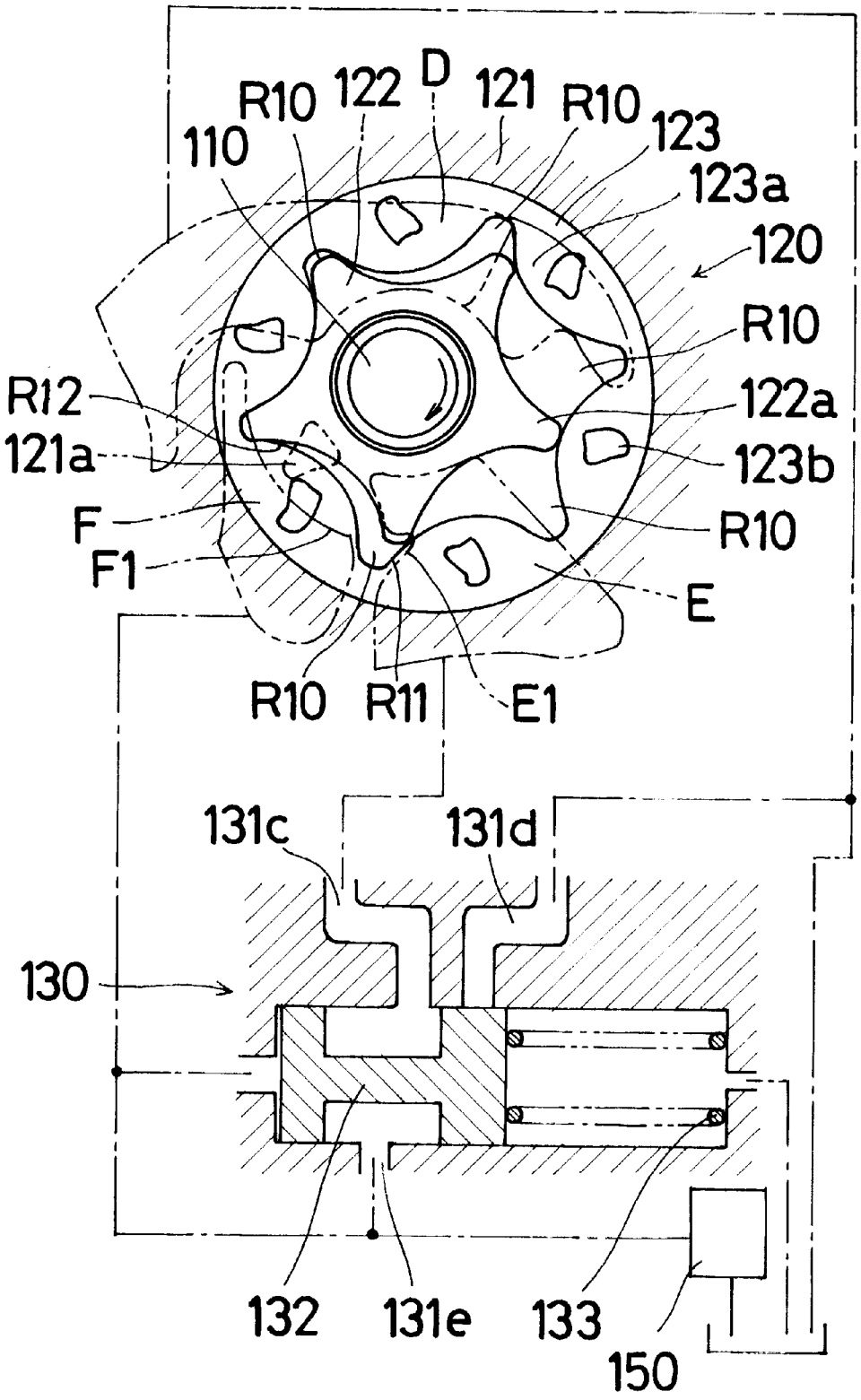
FIG. 7 is a view illustrating the oil pump apparatus in accordance with a second embodiment of the present invention.
Figure 10:
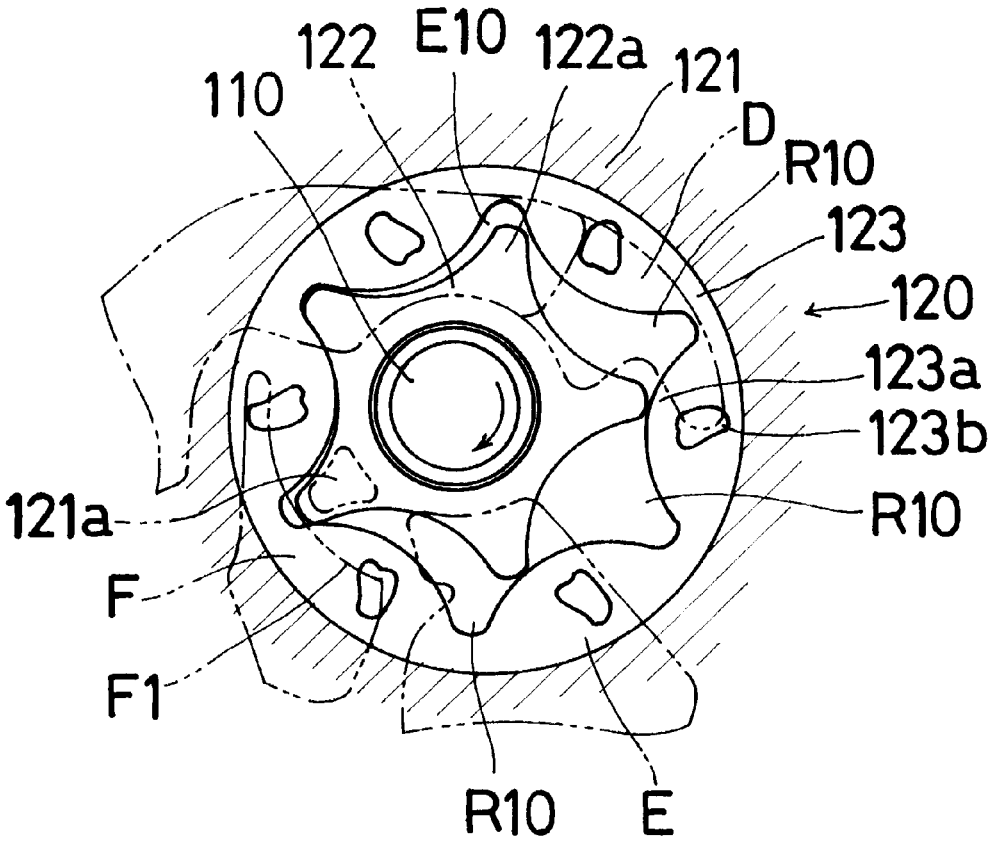
FIG. 10 is a view illustrating the oil pump apparatus in which both rotors shown in FIG. 9 are rotated clockwise.

Accordingly, when the drive rotor 122 and the driven rotor 123 are rotated clockwise and the pump chamber R10 communicated to the first discharge port E is rotated toward the location where the pump chamber R10 is sealed momentarily (namely, when the pump chamber R10 communicated to the first discharge port E is rotated from the location shown in FIG. 10 to the location shown in FIG. 7), the end portion of the pump chamber R10 in the rotational direction does not overlap with the second discharge port F and is not communicated to the second discharge port F. Accordingly, while the first discharge port E communicated to the suction port D with the actuation of the control valve 130 shown in FIG. 7 (while a spool 131 disposed in the control valve 130 slides against the biasing force of a spring 133 and closes the connection between a port 131*c* and a port 131*e* and connects the port 131*c* to a port 131*d*), the first discharge port E is not communicated to the second discharge port F through the pump chamber R10 and the high pressure hydraulic oil does not flow from the second discharge port F into the first discharge port E through the pump chamber R10. Therefore, the amount of the hydraulic oil supplied to the hydraulic oil receiving portion 150 is prevented from decreasing. Further, the pulsation of the hydraulic pressure decreases and the generation of the noise is also prevented. Now, the control valve 130 is the same as the control valve disclosed in U.S. Pat. No. 5,547,349.

Figure 8:
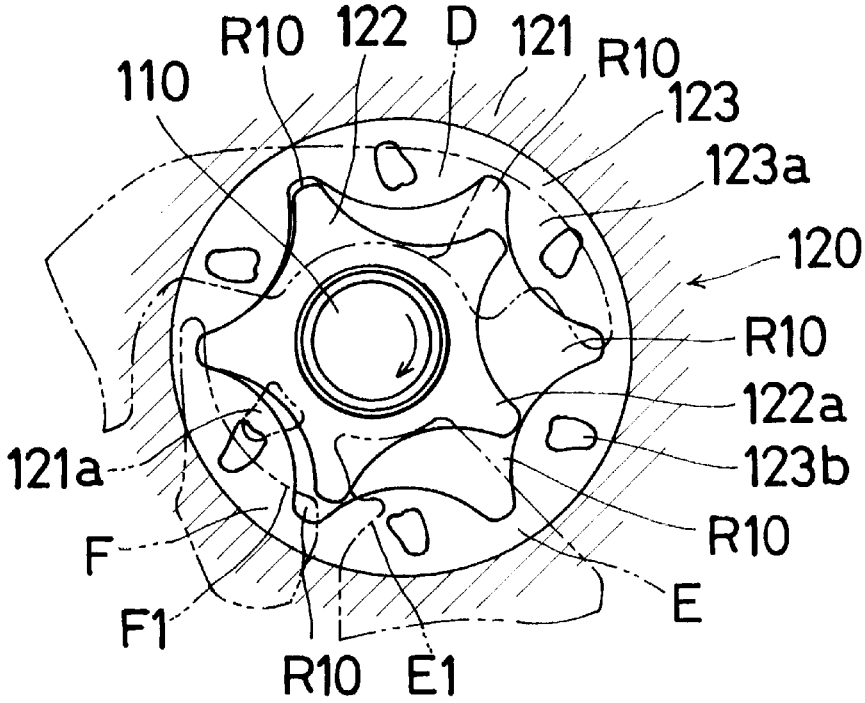
FIG. 8 is a view illustrating the oil pump apparatus in which both rotors shown in FIG. 7 are rotated clockwise.
Figure 9:
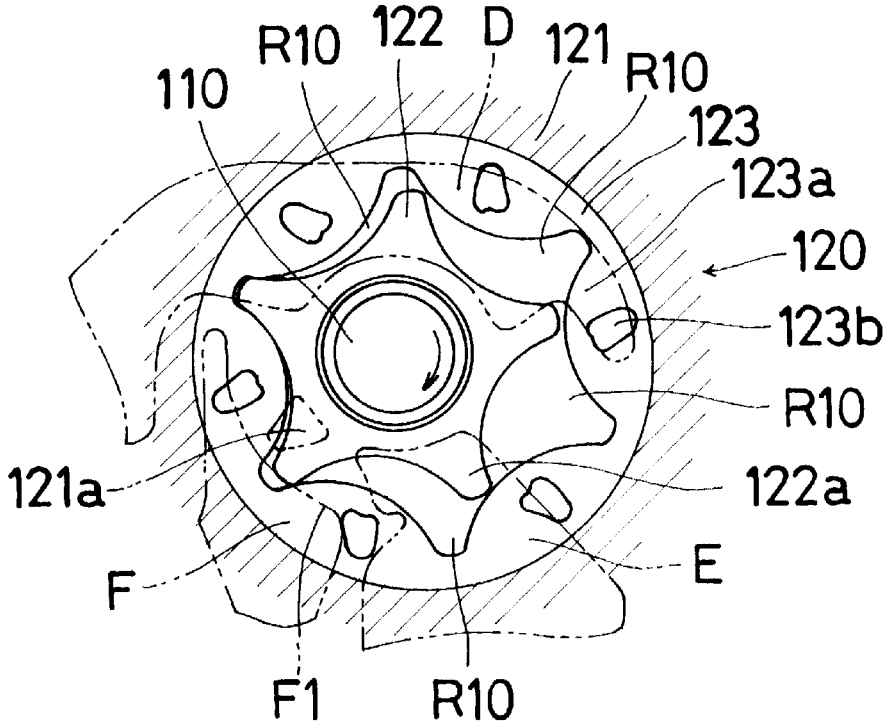
FIG. 9 is a view illustrating the oil pump apparatus in which both rotors shown in FIG. 8 are rotated clockwise.

Further, the driven rotor 123 is provided with a plural first pockets 123*b* in each inner teeth at equal intervals in circumferential direction, and the pump housing 121 is provided with a second pocket 121*a*. It is able to form each of the first pockets 123*b* by penetrating a hole. Each first pocket (concave portion) 123*b* is formed on both sides of driven rotor 123. Now, each first pocket 23*b* can be formed at least on either side of driven rotor 123. Each first pocket 23*b* is formed so as to be able to communicate with the second discharge port F at the outer circumferential portion thereof and so as not to be communicated to the suction port D, the first discharge port E and the second discharge port F at the same time. Accordingly, referring to FIGS. 7 and 8, when the first pocket 123*b* is located between the suction port D and the first discharge port E, the first pocket 123*b* cannot be communicated to both of the port D and the port E. Referring to FIG. 9, when the first pocket 123*b* is located between the first discharge port E and the second discharge port F, the first pocket 123*b* cannot be communicated to both port E and port F. Further, when the first pocket 123*b* is located between the second discharge port F and the suction port D, the first pocket 123*b* cannot be connected to both ports F and D.

On the other hand, the second pocket (concave portion) 121*a* is formed at the inner circumferential portion located at the inner side with respect to the second discharge port F on the surface of the pump housing 121 on which each sliding side surface of a drive rotor 122 and a driven rotor 123 faces. It is able to form the second pocket 121*a* on the pump housing 121 so as to face at least either of the sliding side surfaces of the drive rotor 122 and the driven rotor 123. The second pocket 121*a* can be closed by the outer teeth 122*a* of the drive rotor 122 as shown in FIG. 10 and can be communicated to each of the pump chambers R10 and the inner circumferential portion of the each of the first pockets 123*b* formed on the driven rotor 23 as shown in FIGS. 7, 8 and 9. Further, while each of the pump chambers R10 is communicated to the second discharge port F as shown in FIG. 8, the second pocket 121*a* can communicate each of the pump chambers R10 to the second discharge port F through the each of the first pocket 123*b* formed on the driven rotor 123.

Further, in a condition shown in FIG. 8 just after the pump chamber R10 is sealed momentarily as shown in FIG. 7, the hydraulic oil is discharged from the pump chamber R10 to the second discharge port F through the end portion of the second discharge port F on the side of the anti-rotational direction, and a portion of the pump chamber R10 that overlaps with the end portion of the second discharge port F on the side of the anti-rotational direction, and the hydraulic oil is discharged from the pump chamber R10 to the second discharge port F through the first pocket 123*b* and the second pocket 123*a*. Therefore, since a plural discharge passages from the pump chamber R10 to the second discharge port F are formed, the area of the communicating passage between the pump chamber R10 and the second discharge port F can be increased and the flow resistance can be decreased. As a result, the pumping loss can be decreased and the pulsation can also be decreased.

In the above mentioned embodiment, although the present invention is practiced as the oil pump apparatus 20 and 120 driven respectively by the crank shaft 10 and 110 of the vehicle engine (internal combustion engine), the present invention can also be practiced as an oil pump apparatus for use in industrial equipment other than vehicle with or without appropriate modifications, and the type of pump (a trochoid-type pump being used in the above described embodiment) or the driving method (direct connection driving method being employed in the above described embodiment) can be changed appropriately.

What is claimed is:

1. An oil pump apparatus comprising:

an oil pump housing including a first suction port, a second suction port and a discharge port in the circumferential direction thereof;

a drive rotor and a driven rotor disposed rotatably eccentrically in a oil pump housing and forming a plurality of pump chambers in the circumferential direction of a rotor; and each of the pump chambers communicating to the first suction port, the second suction port and the discharge port in order, respectively when the drive rotor and the driven rotor are rotated;

wherein a shape of an end portion in the anti-rotational direction of the second suction port is formed so as to be along a shape of a first end portion in the rotational direction of one of the pump chambers which is sealed momentarily between the first suction port and the second suction port, and a shape of an inner circumferential end portion of the first suction port is formed so as to be along a rotational trace of a second end portion in the anti-rotational direction of said one of the pump chambers, the rotational trace of the second end portion is composed of a plurality of contact points of the drive rotor and the driven rotor, and wherein a plural first pockets, which are selectively communicated to the first suction port at an outer circumferential portion thereof and which are not communicated to each port at the same time, are formed on the driven rotor, and a second pocket, which is located on an inner circumferential portion of the pump housing and closer to the drive rotor than the first suction port, is selectively communicated to said one of the pump chambers and the first suction port via an inner circumferential portion of one of the first pockets when said one of the pump chambers is communicated to the first suction port.

2. An oil pump apparatus as recited in claim 1, wherein the driven rotor has a plurality of inner teeth, and the first pockets are formed at regular intervals in a circumferential direction in correspondence to the inner teeth of the driven rotor.

3. An oil pump apparatus comprising:

an oil pump housing including a suction port;

a first discharge port and a second discharge port in the circumferential direction thereof, a drive rotor and a driven rotor disposed rotatably eccentrically in a oil pump housing and forming a plurality of pump chambers in the circumferential direction of a rotor; and each of the pump chambers communicating to the suction port, the first discharge port and the second discharge port in order, respectively, when the drive rotor and the driven rotor are rotated;

wherein a shape of an end portion on a rotational direction side of the first discharge port is formed so as to be along a shape of a first end portion on an anti-rotational direction side of one of the pump chambers which is sealed momentarily between the first discharge port and the second discharge port, and a shape of an inner circumferential end portion of the second discharge port is formed so as to be along a rotational trace of a second end portion on a rotational direction side of said one of the pump chambers, the rotational trace of the second end portion is composed of a plurality of contact points of the drive rotor and the driven rotor, and wherein a plural first pockets, which are selectively communicated to the second discharge port at an outer circumferential portion thereof and which are not communicated to each port at the same time, are formed on the driven rotor, and a second pocket, which is located on an inner circumferential portion of the pump housing and closer to the drive rotor than the second discharge port, is selectively communicated to said one of the pump chambers and the second discharge port via an inner circumferential portion of one of the first pockets when said one of the pump chambers is communicated to the second discharge port.

4. An oil pump apparatus as recited in claim 3, wherein the driven rotor has a plurality of inner teeth, and the first pockets are formed at regular intervals in circumferential direction in correspondence to the inner teeth of the driven rotor.

5. An oil pump apparatus as recited in claim 1, wherein the first pockets comprise a plurality of penetrating holes.

6. An oil pump apparatus as recited in claim 3, wherein the first pockets comprise a plurality of penetrating holes.

* * * * *